United States Patent [19]

Stojek

[11] Patent Number: 4,465,644

[45] Date of Patent: Aug. 14, 1984

[54] CARBURETOR WITH AN INDUCTOR PASSAGE CONTROLLED BY A THROTTLE SLIDE

[75] Inventor: Dieter Stojek, Bergisch Gladbach, Fed. Rep. of Germany

[73] Assignee: Ford Motor Company, Dearborn, Mich.

[21] Appl. No.: 526,833

[22] Filed: Aug. 26, 1983

[30] Foreign Application Priority Data

Sep. 2, 1982 [DE] Fed. Rep. of Germany ..... 3232609

[51] Int. Cl.[3] ..... F02M 9/06

[52] U.S. Cl. ..... 261/44 B; 261/DIG. 56; 251/158; 251/326

[58] Field of Search ..... 261/44 B, 44 C, DIG. 56; 251/158, 326

[56] References Cited

U.S. PATENT DOCUMENTS

| | | | |
|---|---|---|---|
| 1,656,183 | 1/1928 | Enz | 251/158 |
| 1,793,148 | 2/1931 | Warlay | 261/44 B |
| 3,216,694 | 11/1965 | Perazone | 251/158 |
| 3,321,174 | 5/1967 | Schertler | 251/158 |
| 3,397,862 | 8/1968 | Batzer et al. | 251/158 |
| 3,822,058 | 7/1974 | Carter | 261/44 B |
| 3,907,250 | 9/1975 | Kane | 251/158 |
| 3,965,221 | 6/1976 | Englert et al. | 261/44 B |
| 4,221,747 | 9/1980 | Edmonston | 261/44 B |

FOREIGN PATENT DOCUMENTS

| | | | |
|---|---|---|---|
| 53-147131 | 12/1978 | Japan | 261/DIG. 56 |

*Primary Examiner*—Tim Miles

*Attorney, Agent, or Firm*—Robert E. McCollum; Clifford L. Sadler

[57] ABSTRACT

A carburetor has a throttle member in the form of a laterally movable slide controlling the size of the induction passage. At planar edge areas of the guide surfaces, the slide is sealingly and slidably guided on a surface extending normal to the induction passage. The slide is unloaded from vertical downward pressures exerted on the guide surfaces by an unloading mechanism controlled by engine manifold vacuum. Such an unloading mechanism can consist of a parallelogram lever arrangement which through a pressure chamber actuates lifting rails arranged laterally to the guide surfaces. The slide is supported on the lifting rails by roller arrangements.

4 Claims, 4 Drawing Figures

CARBURETOR WITH AN INDUCTOR PASSAGE CONTROLLED BY A THROTTLE SLIDE

Figure 1:
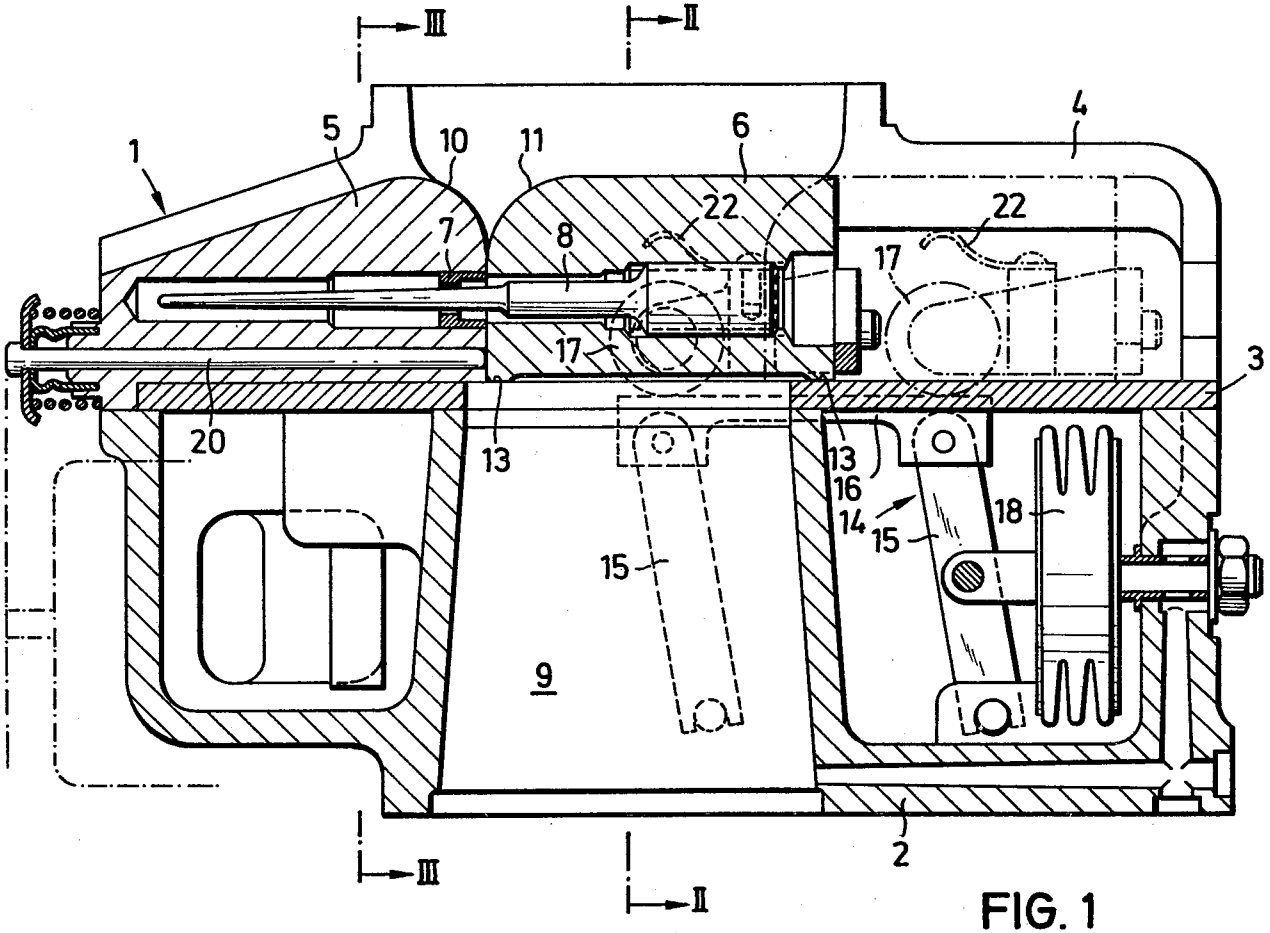

The invention relates to a carburetor with an induction passage controlled by a slide type throttle valve.

A recent version of such a carburetor, i.e., one without a butterfly type throttle valve, can be seen in U.S. Pat. No. 4,221,747 to Edmonston showing basically a motor-cycle carburetor.

In the past, there has been poor air flow in the area of the fuel jet, and the friction of the slide in its guides has been unduly high.

According to the prior art, these disadvantages are overcome by inclination of the leading edge of the throttle slide and/or through a reduction in the sliding surfaces of the slide.

Despite these improvements, this known version has the significant disadvantage that particularly at part open settings, the pressure diferential on opposite sides of the slide results in excessive loading of the slide piston, which increases considerably the pressure on the edges of the slide guide so that the slide operation occurs jerkily.

The slide of the invention is released from the downward pressure exerted by the effective vacuum on its guide surfaces through an unloading device controlled by the vacuum. The necessary compression required for a secure seal can be ensured within narrow margins so that an unwanted increase of the downward pressure and the thereby resultant difficulty in manipulation leading to jerky adjusting movements is avoided.

The unloading device can consist of a simple parallelogram lever arrangement in which lifting rails located adjacent the side of the guide surfaces are operated by means of a pressure compensating chamber or bellows. The lifting rails support the slide upwardly through roller arrangements whereby the degree or extent of the unloading can be determined through a choice of the size of the pressure chamber and/or through the angulation of the parallelogram.

A carburetor with such an unloading device can be designed with a fuel needle valve fixed to the slide and movable in a fuel jet positioned opposite the slide, the slide preferably being actuated by an electronic control to avoid an uneven positioning that normally results from a slide being manually controlled by the driver.

Such a carburetor is preferably designed so that the area of the flow between the rounded air inlet edge of the slide and the rounded air inlet edge of the corresponding jet block part positioned opposite is constructed as a venturi jet, the narrowest cross-section of which determines the flow capacity and lies at the sliding surface of the slide so that each slide setting corresponds to a single defined flow cross-section and thereby the flow quantity is determined by means of the slide setting and the vacuum level.

The carburetor can also have an idle speed control as well as a pressure cut-off (slide totally closed) controlled by an electronic stopping device.

The unloading device of the invention can equally be used in a carburetor having a known mechanically operated slide. The fuel flow, in this case controlled by movement of a needle valve in a fuel jet, is modified by the addition of an air mixture nozzle that electronically controls the amount of air to the fuel flow in order to optimize the fuel-air mixture at all operating conditions of the internal combustion engine.

The unloading device of the invention can also be used with a carburetor in which the slide not only is mechanically operated but controls only the air flow, and an electronic control is used for moving a fuel needle valve within a fuel jet located in the opposite side wall.

It is an object of the invention, therefore, to provide a carburetor of the sliding throttle valve type with a pressure unloading device controlled by changes in the engine manifold vacuum to reduce the horizontal sliding movement effort of the slide.

Figure 2:
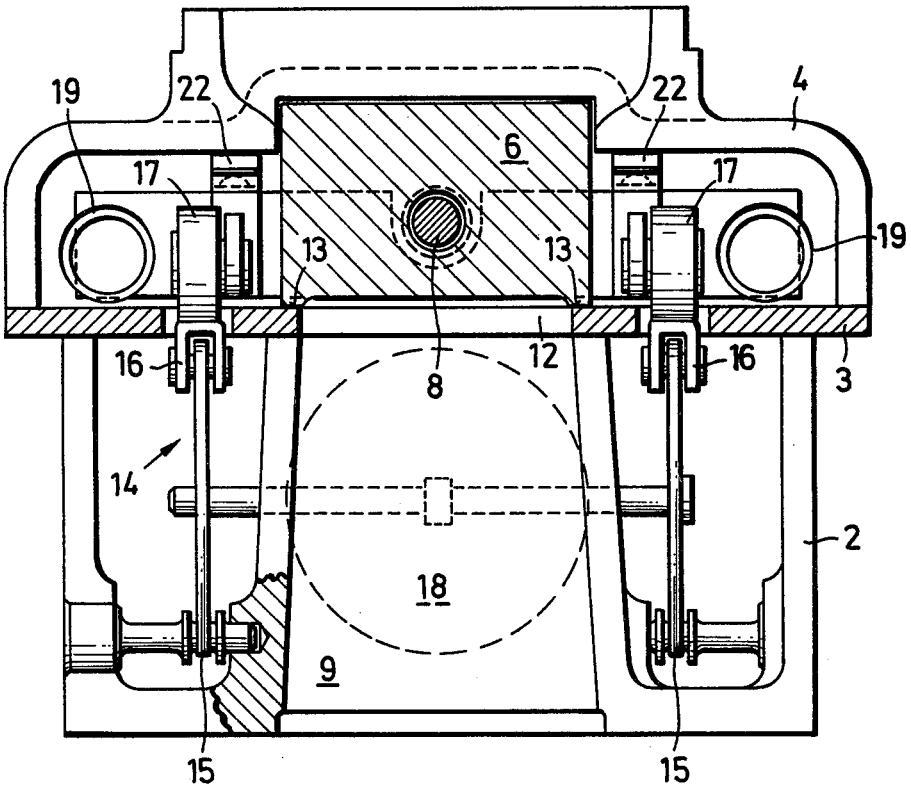
Figure 3:
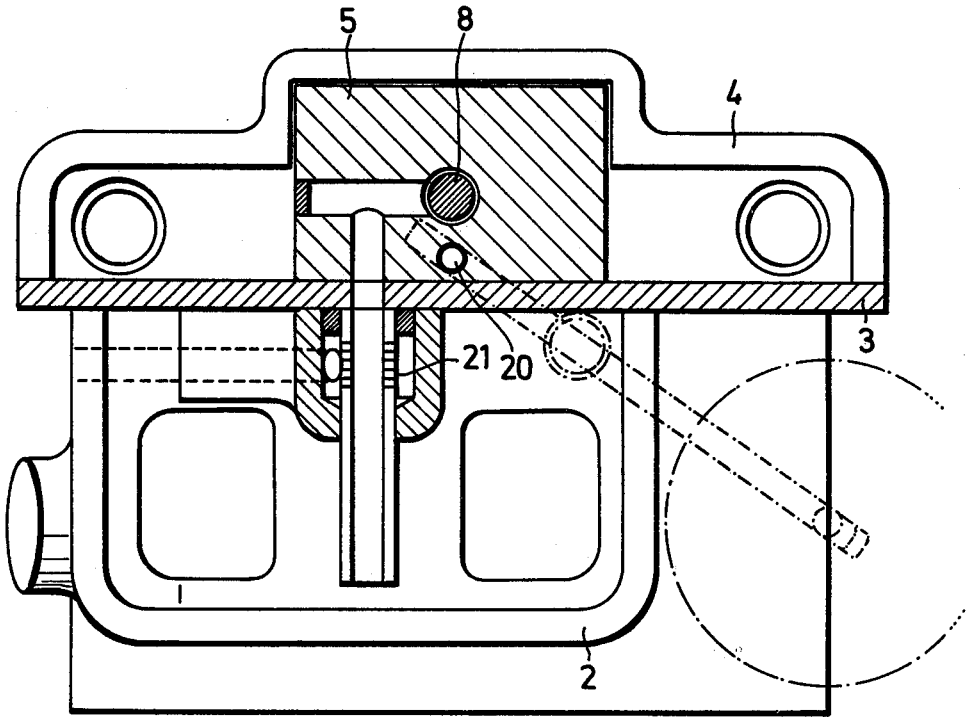
Figure 4:
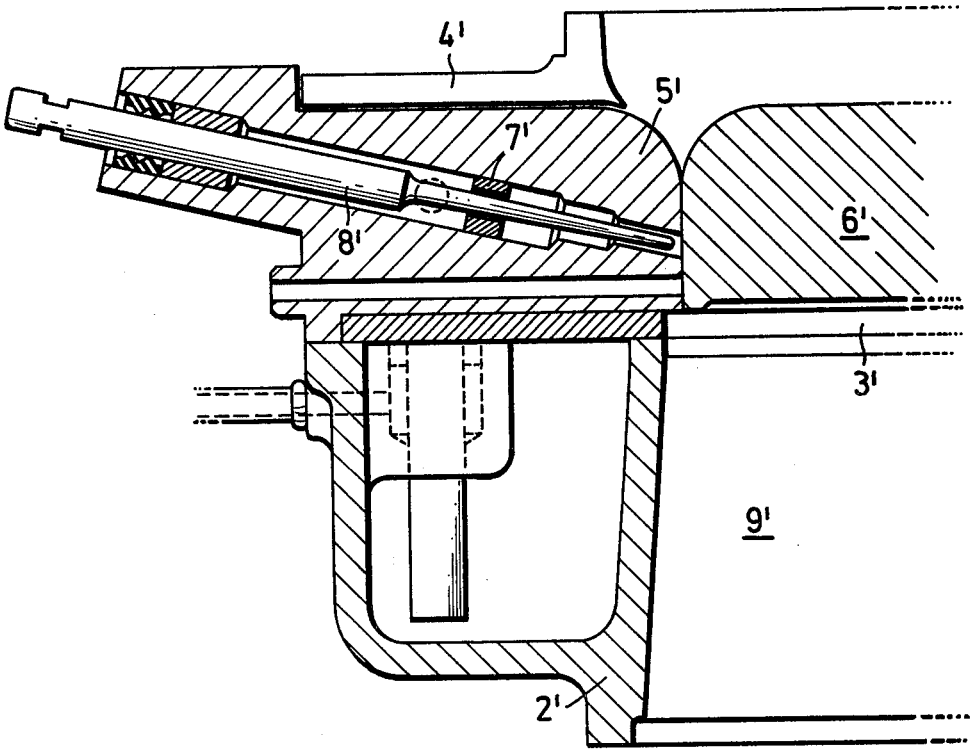

Other objects, features and advantages of the invention will become more apparent upon reference to the succeeding detailed description thereof, and to the drawings illustrating the preferred embodiments thereof; wherein, FIG. 1 is a vertical cross-sectional view through a carburetor embodying the invention;

FIGS. 2 and 3 are cross-sectional views along the lines II—II and III—III, respectively, in FIG. 1; and FIG. 4 is a partial cross-sectional view of another embodiment of the invention.

The carburetor 1 shown in the drawings consists of a main body 2, a central plate 3 and a hollow cover 4. Above the central plate 3, within cover cavity 4, are positioned a fixed jet block 5 and a horizontally or laterally movable throttle slide 6. A fuel jet orifice or nozzle 7 set in jet block 5 receives therein a fuel jet needle valve 8, which is fixed in a known manner to slide 6. At any particular setting of slide 6, which can be adjusted mechanically or electronically in a known manner, as desired, the air and fuel inducted into induction passage 9 of the carburetor will thereby be controlled.

As best seen in FIGS. 1 and 2, the induction passage 9 of the carburetor 1 has a rectangular cross-section, and the facing adjacent cooperating wall parts 10 and 11 of jet block 5 and throttle slide 6 are curved to form a variable area, optimized flow, venturi-type passage between.

The precise cross-section of induction passage 9 is determined by an opening 12 (FIG. 2) in central plate 3 between the main body 2 and the carburetor cover 4, and by the size of the gap between the slide 6 and jet block 5. Slide 6 has four flat or planar edge foot-like areas 13 by means of which it is slidably and sealably guided on the peripheral edge areas of central plate 3 that define opening 12. Although such a seal of a slide over its planar edge region normal to the induction passage ensures a good seal, nevertheless at nearly closed settings of slide 6, the large pressure differential between the nearly atmospheric pressure on the top of slide 6 and the manifold vacuum on the bottom of the slide lead to large pressure differences resulting in large vertical downward load on the slide surfaces. Particularly at part load ranges, with high vacuum beneath slide 6, an undesirable high load results which can lead to jerky movement when slide 6 is operated.

The slide 6 is unloaded from the pressure exerted on the guide surfaces by the vacuum by an unloading mechanism 14 controlled by the vacuum. The unloading mechanism 14, as best seen in FIGS. 1 and 2, consists of a parallelogram lever arrangement 15. At its lower articulation points, it is pivotally mounted in the main body 2. At its upper articulation points, it is pivoted on channel shaped lifting rails 16 located at the sides of the guide surfaces. Rollers 17, rotatably fixed on slide 6 by a yoke shaped bracket, as best seen in phantom lines in FIG. 1, are supported on the lifting rails at the side of the guiding surfaces, and are arranged roughly at the effective point of application of the resulting vacuum force acting on the underside of slide 6. The slide is adapted to be moved laterally as seen in FIG. 1, either mechanically or electronically, by any known suitable means, not shown.

A vacuum chamber defined by a bellows 18 is pivotally connected to the parallelogram lever arrangement by a central cross-shaft, as best seen in FIG. 2. The hollow interior of bellows 18 is connected to the induction passage vacuum in passage 9 below slide 6 by the right angled interconnecting passage shown in FIG. 1, to effect an expansion or contraction of the bellows 18 with changes in the engine manifold vacuum level. The force of the vacuum in bellows 18 exerted upwardly on slide 6 through lifting rails 16 and wheels 17 is designed to essentially balance or unload the vertical downward forces acting on slide 6 as a result of the vacuum existing below the slide, to the extent that the downward pressure on the edge regions 13 of the guide surfaces, which is necessary for maintenance of a tight seal, is able to be maintained within narrow limits. Alternatively, the force produced by the vacuum may be completely removed by changing the angles of the parallelogram levers and/or the dimensions of bellows 18, and the pressure necessary for the sealing could be produced by mechanical means, such as spring 22, for example.

The adjustment of slide 6 can, as mentioned previously, be accomplished mechanically. At the side of slide 6, tension springs 19 (FIG. 2) can be provided which would return a slide that has been opened, by the pull of a Bowden cable, for example, back to its closed position. Preferably, in the jet block 5 positioned opposite slide 6, an adjustable abutment or stop 20 (FIG. 1) can be arranged by means of which an idle setting of slide 6 can be made adjustable either manually or under electronic control in dependence on operating conditions.

In FIG. 3, the possibility is shown of modifying a conventional mechanically controlled slide that provides fuel metering by means of a fuel jet needle valve moving with the slide into an oppositely located fuel nozzle. In the area of the fuel nozzle, an air mixture nozzle 21 is provided, which electronically controls the admission of air to the fuel nozzle in such a way that the mixture preparation takes into account all operating conditions of an internal combustion engine.

From FIG. 4 the possibility can be appreciated of providing, in a carburetor with a mechanically controlled slide 6', a fuel supply totally independent of movement of the slide. In this case, the fuel jet or nozzle 7' and fuel jet needle valve 8' are both placed in the jet block 5'. The movement of the fuel jet needle valve 8' can be controlled by an electronic control, not shown, in accordance with the operating conditions of the internal combustion engine. This electronically controlled jet needle valve can also be combined with the previously described air-supply nozzle 21 shown in FIG. 3.

Inasmuch as the fuel control in FIG. 4 is separate from the air intake control and carried out electronically, a mixture preparation can be achieved in such a carburetor which fulfills all the operating requirements of the engine, i.e., idling, cold start, fuel shut-off when stopping, idling speed stabilization, acceleration enrichment and the like, without the addition of expensive supplementary mechanisms.

Obviously, it is also possible to provide the usual separate idling system in such a carburetor if it is desired, to simplify the product or to simplify its necessary maintenance.

In operation, assuming the engine is running, and slide 6 in FIG. 1 is located slightly to the right of the position shown in FIG. 1, to an idle speed position. The rod or stop 20 will have been moved manually or electronically, as the case may be, to determine this position. Accordingly, a high engine manifold vacuum force will exist in passage 9 below slide 6, and a corresponding vacuum force in bellows 18. This results in close to a maximum contraction of bellows 18, and an attempted pivoting of the parallelogram levers 15 rightwardly and thereby lifting of the lifting rails arcuately in a clockwise direction. This clockwise movement attempts to swing the lifting rails upwardly against wheels 17 thereby exerting an upward camming force on slide 6 designed to counteract the downward pressure differential force on the slide caused by the difference between the essentially atmospheric pressure on the upper or top side of slide 6 and the high manifold vacuum or negative pressure on the bottom side. As will be seen, the upward balancing force will continuously change in proportion to the changes in manifold vacuum level in response to change in position of slide 6, to always balance or nearly balance the pressure differential acting on slide 6. This, therefore, essentially unloads the slide 6 from unwanted pressure forces, except for those designed to maintain a seal at edges 13, and permits a smooth horizontal movement of slide 6.

From the foregoing, therefore, it will be seen that the invention provides a means to provide a smooth sliding operation of a throttling device in a carburetor by unloading the slide from the usual vertical pressure differential caused by application of the manifold vacuum forces to the underside of the throttle slide, and that the unloading means can be applied to carburetors having various types of fuel control systems.

While the invention has been shown and described in its preferred embodiments, it will be clear to those skilled in the arts to which it pertains that many changes and modifications may be made thereto without departing from the scope of the invention.

I claim:

1. A carburetor having a slide type throttle member controlling flow through the induction passage, said slide being sealingly and slidably movable laterally on a planar surface extending substantially normal to the induction passage, the slide sealing surfaces being subjected to a vertical downward loading resulting from the pressure differential between a near atmospheric pressure acting on top of the slide and engine intake manifold vacuum acting beneath the slide, and an unloading mechanism responsive to changes in the vacuum below the slide for opposing the vertical downward loading exerted on the guide surface to enable lateral sliding of the slide with minimum effort.

2. A carburetor as in claim 1, wherein the unloading mechanism includes a parallelogram lever arrangement pivotally mounted for an arcuate movement in a vertical plane, the mechanism including wheel means secured to the slide, lifting rails parallel to the slide surface slidably supporting the wheels and engaged by the lever arrangement for a vertical arcuate camming movement of the rails against the slide surface to provide a resultant upward force opposing the downward pressure diferential force on the slide, and means responsive to the changes in vacuum in the induction passage beneath the slide for pivoting the parallelogram arrangement to provide an opposing counteracting force proportional to the changes in vacuum level beneath the slide.

3. A carburetor as in claim 2, wherein the last mentioned means comprises a bellows type pressure chamber connected internally to the vacuum in the induction passage beneath the slide, and pivotally connected to the parallelogram arrangement to exert a force against the lifting rails that varies in response to changes in induction passage vacuum level.

4. A carburetor as claimed in claim 1 or 2, including an assembly of a fuel jet needle valve and cooperating fuel jet nozzle fixed to the carburetor for control of fuel flow in response to movement of the slide, and means for adjusting movement of the slide.

* * * * *